United States Patent [19]

Mertens

[11] Patent Number: 4,761,883

[45] Date of Patent: Aug. 9, 1988

[54] CUTTING TOOL WITH DRAWING CUT

[75] Inventor: Wolfgang Mertens, Solingen, Fed. Rep. of Germany

[73] Assignee: Dovo Stahlwaren Bracht GmbH & Co KG, Solingen, Fed. Rep. of Germany

[21] Appl. No.: 51,045

[22] Filed: May 15, 1987

[30] Foreign Application Priority Data

Jan. 15, 1987 [DE] Fed. Rep. of Germany ..... 3701049

[51] Int. Cl.[4] ..... B26B 13/00

[52] U.S. Cl. ..... 30/239; 30/254

[58] Field of Search ..... 30/239, 254, 341, 237, 30/252

[56] References Cited

U.S. PATENT DOCUMENTS 31,849 3/1861 Knapp ..... 30/239

467,025 1/1892 Wreden ..... 30/239

2,837,823 6/1958 Petrocelli ..... 30/239

2,965,967 12/1960 Wahl ..... 30/254 X

*Primary Examiner*—E. R. Kazenske

*Assistant Examiner*—Michael D. Folkerts

*Attorney, Agent, or Firm*—Henry M. Feiereisen

[57] ABSTRACT

A cutting tool, especially a scissors with drawing cut includes a lower shear blade pivotally connected to an upper shear blade by a bolt or other suitable means which projects into an oblong hole of the upper shear blade. The lower shear blade is provided with a straight groove which extends slantingly to the longitudinal axis of the lower shear blade and is engaged by a pin which is part of a plate-shaped injection molded part snugly inserted in the upper shear blade and including the oblong hole.

6 Claims, 1 Drawing Sheet

CUTTING TOOL WITH DRAWING CUT

FIELD OF THE INVENTION

The present invention refers to a cutting tool, and in particular to a scissors with drawing cut.

BACKGROUND OF THE INVENTION

In common scissors in which the upper shear blade and the lower shear blade are pivoted to each other in form of a bolt or a rivet, the workpiece is forced in direction of the tip of the scissors because of the wedge-action cutting of the cutting edges. This wedge-type cutting is disadvantageous e.g. during cutting of hair especially of tuft of hair because the cut does not occur at a right angle but slantingly so that splitting of hair has been frequently encountered. Further, this wedge-type cutting renders it rather difficult to create and maintain a straight cut line.

Therefore, it has long been proposed to provide scissors with drawing cut. These scissors, however, did not find application in practice because of their complicated construction. In addition, they are too susceptible to wear and/or proved to be too impractical with regard to handling because of their projecting parts.

From the German patent DE-PS No. 66 126, scissors with drawing cut are known which include a lower shear blade and an upper shear blade pivotally connected to each other by a bolted connection with the bolt projecting in a slot of the upper shear blade. The lower shear blade has a guide coulisse extending slantingly to the longitudinal axis thereof and cooperating with a pin of the upper shear blade so that the latter shifts relative to the lower shear blade during closing of the scissors. The slot of the upper shear blade as well as the guide coulisse are of curved shape. In addition, the upper shear blade supports a pivot about which a rod member is rotatably mounted. At a distance to the pivot, the rod member is also rotatably mounted about the bolt for relieving the bolt and to allow greater tolerances when designing the curved slot which is engaged by the bolt.

Such scissors are disadvantageous because of the considerable width of their shear blades and because the opening angle of the scissors is limited to an angle of about 45°.

German patent DE-PS No. 11 794 discloses a scissors whose lower shear blade has a bolt projecting into an oblong hole of the upper shear blade. In addition, the scissors is provided with a joint defined by a toothing in the upper shear blade and several pins spaced on the lower shear blade about an arc of a circle and adapted for engagement in the toothing.

German patent DE-PS No. 44 229 describes a scissors for providing a drawing cut which includes an upper shear blade with a curved slot traversed by a bolt of the lower shear blade and a guideway cooperating with two spaced pins projecting from the lower shear blade so as to guide the scissors during opening and closing thereof.

German publication DE-OS No. 34 07 117 shows a scissors in which the upper shear blade includes an oblong hole parallel to its longitudinal axis for receiving the bolted connection and a further oblong hole extending at an angle to the longitudinal axis of the upper shear blade for guiding a pin inserted in the lower shear blade. This scissors has been proven to be disadvantageous with regard to maintaining tolerances especially when demanding smoothness of the scissors and a wide opening angle of e.g. more than 70°.

SUMMARY OF THE INVENTION

It is an object of the present invention to provide an improved cutting tool, in particular a scissors with drawing cut obviating the afore-stated drawbacks.

This object and others which will become apparent hereinafter is attained, in accordance with the present invention by providing the lower shear blade with a straight groove extending at an angle to the longitudinal axis thereof and providing the upper shear blade with an insert which includes a straight oblong hole for engagement with a bolt or the like for pivotally connecting the upper shear blade with the lower shear blade and which includes a pin projecting into the straight groove of said lower shear blade for allowing a displacement of the upper shear blade relative to the lower shear blade.

Preferably, the insert is an injection molded part of wear-resisting, self-lubricating plastic material like e.g. polytetrafluoroethylene.

Scissors designed in accordance with the present invention are easy to manufacture and to handle and combine the advantages of a drawing cut for providing a clean cut of the workpiece with a straight cut line, with the advantages of conventional scissors, namely their smoothness, the prevention of projecting parts, durability and—if necessary—wide opening angle at still slender shear blades. Thus, the scissors according to the invention are especially suitable for commercial application e.g. for hair cutters or tailors.

BRIEF DESCRIPTION OF THE DRAWING

The above and other objects, features and advantages of the present invention will now be described in more detail with reference to the accompanying drawing in which.

DESCRIPTION OF PREFERRED EMBODIMENTS

Figure 1:
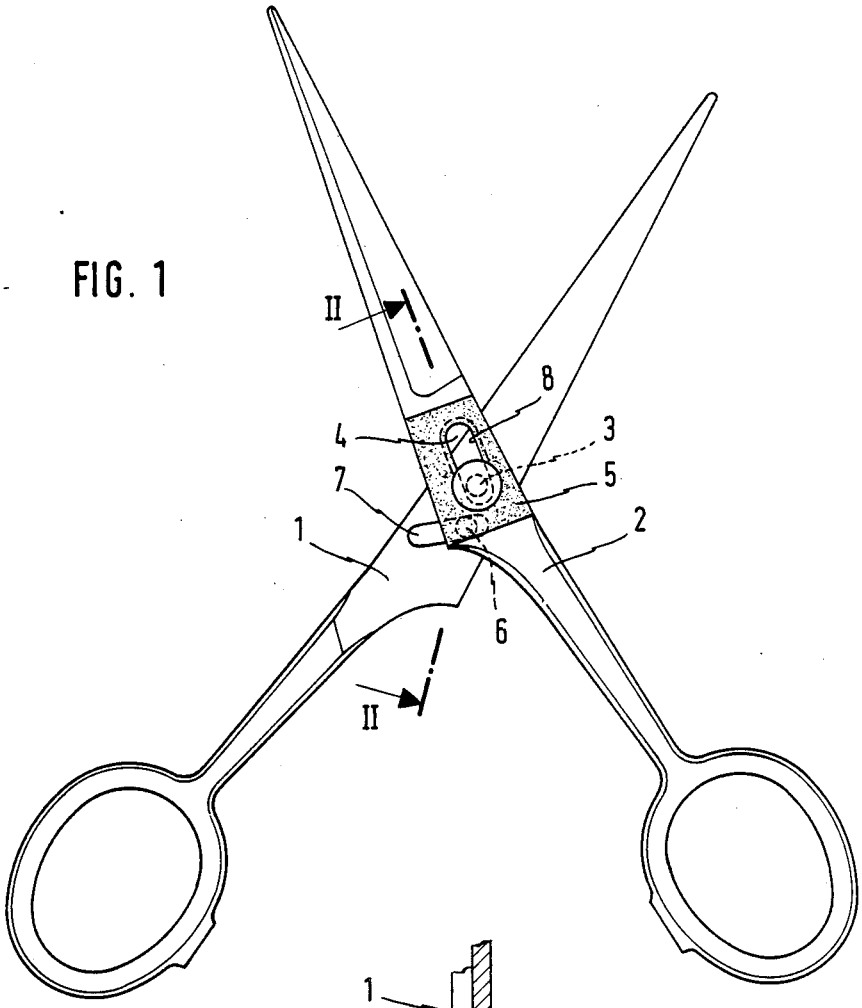
FIG. 1 is a front elevational view of one embodiment of a scissors according to the invention in open position.

In the drawing, there is illustrated one embodiment of a scissors in accordance with the present invention and including a lower shear blade 1 pivotally connected to an upper shear blade 2. In the present embodiment, the connection between the blade 1 and 2 is provided by a rivet 3 which is disposed in the lower blade 1 and projects through an oblong hole 4 of the upper blade 2. It is certainly possible to provide the pivot connection by any other suitable means e.g. by substituting the rivet 3 by a bolt or screw.

The lower and upper shear blades 1 and 2 are integrally connected with pertaining grip eyes 1*a* and 2*a* for allowing the scissors to be operated by a finger and a thumb.

Figure 2:
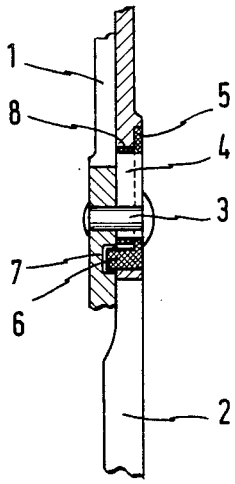
FIG. 2 is a cross sectional view of the scissors taken along the line II—II in FIG. 1.

As is especially illustrated in FIG. 2, the inner wall surface of the upper shear blade 2 defining the oblong hole 4 is entirely linked with a coating 8 which is part of an insert 5. In the nonlimiting example as shown in the drawing, the insert 5 is an injection molded part which is made of wear-resisting, self-lubricating plastic material e.g. polytetrafluoroethylene (PTFE) and is provided essentially in the shape of a plate snugly or flush mounted within a pertaining complementary recess 9 in the upper side of the upper shear blade 2 so that the outer surface of the insert 5 is in the same plane as the surface of the upper shear blade 2.

The upper shear blade 2 is further provided with a bore 10 which is disposed at a location closer to the grip eyes 1*a*, 2*a* than the rivet 3 and near the outer edge or back of the blade 2. Traversing the bore 10 is a pin 6 which is part of the injection molded part 5 and protrudes in a straight groove 7. The groove 7 is milled in the lower shear blade 1 and extends at an angle $\alpha$ to the longitudinal axis 11 of the shear blade 1. The length of the groove 7 defines the maximum opening angle of the scissors while the angle $\alpha$ of the groove 7 relative to the longitudinal axis 11 of the lower shear blade 1 and the length of the oblong hole 4 define the relative displacement of the upper shear blade 2 relative to the lower shear blade 1 during closing of the scissors in direction toward the eyes 1*a*, 2*a*. The relative displacement is augmented with increasing closure of the scissors.

While the invention has been illustrated and described as embodied in a scissors with drawing cut, it is not intended to be limited to the details shown since various modifications and structural changes may be made without departing in any way from the spirit of the present invention.

What is claimed as new and described to be protected by Letters Patent is set forth in the appended claims.

I claim:

1. A cutting tool with drawing cut, comprising:

a lower shear blade defining a longitudinal axis and including a straight groove extending at an angle to said longitudinal axis;

an upper shear blade provided with a straight oblong hole; and connecting means engaging said oblong hole for pivotally joining said upper shear blade with said lower shear blade, said upper shear blade accommodating an insert which includes said oblong hole and said insert is provided with a pin projecting into said groove of said lower shear blade for allowing a displacement of said upper shear blade relative to said lower shear blade, said insert being an injection molded part of wear-resisting, self lubricating plastic material flush mounted in said upper shear blade so as to provide bearing surfaces for said connecting means and said groove.

2. A cutting tool as defined in claim 1 wherein said pin forms a one piece unit with said injection molded part.

3. A cutting tool as defined in claim 1 wherein said injection molded part is made of polytetrafluoroethylene.

4. A cutting tool as defined in claim 1 wherein said pin is made of plastic material.

5. A cutting tool as defined in claim 1 wherein said upper shear blade is provided with a recess, said insert being plate-shaped and accommodated in said recess.

6. A cutting tool as defined in claim 1 wherein said straight oblong hole in said upper shear blade extends at an angle to said straight groove in said lower shear blade.

* * * * *